US005125459A

United States Patent [19]

Richards

[11] Patent Number: 5,125,459

[45] Date of Patent: Jun. 30, 1992

[54] APPARATUS FOR SMOOTHING GRANULAR MATERIAL

[76] Inventor: Stephen J. Richards, 1034 Hermosa Dr., Anaheim, Calif. 92801

[21] Appl. No.: 660,514

[22] Filed: Feb. 22, 1991

[51] Int. Cl.[5] ..... A01B 1/14

[52] U.S. Cl. ..... 172/380; 294/49; 15/235.4; 172/378

[58] Field of Search ..... 172/380, 381, 378, 371, 172/370; 56/400.4, DIG. 18, 420.16, 400.21; 294/49, 50.6; 15/235.4, 235.6; D8/3, 13

[56] References Cited

U.S. PATENT DOCUMENTS

| | | | |
|---|---|---|---|
| D. 274,118 | 6/1984 | Cochrane | 172/378 |
| D. 281,852 | 12/1985 | Poole | D8/13 |
| D. 297,101 | 8/1988 | Licht | D8/13 |
| D. 298,725 | 11/1988 | Sunila et al. | D8/13 |
| D. 303,912 | 10/1989 | Butler | D8/13 |
| D. 306,682 | 3/1990 | Thompson | D8/13 |
| D. 308,805 | 6/1990 | Licht | D8/13 |
| D. 314,122 | 1/1991 | Licht | D8/13 |
| 969,528 | 9/1910 | Disbrow | 294/49 |
| 2,546,113 | 3/1951 | Spang | 294/49 |
| 4,866,922 | 9/1989 | Clark | 56/400.04 |
| 4,871,029 | 10/1989 | Rosin | 172/378 |
| 5,012,872 | 5/1991 | Cohn | 172/380 |

FOREIGN PATENT DOCUMENTS

| | | | |
|---|---|---|---|
| 2202450 | 9/1988 | United Kingdom | 172/371 |

*Primary Examiner*—Randolph A. Reese
*Assistant Examiner*—Spencer Warnick
*Attorney, Agent, or Firm*—Christie, Parker & Hale

[57] ABSTRACT

A one-piece leveling device for smoothing and leveling granular materials comprising a rigid flat elongated body having upper and lower portions, each a predetermined configuration, aperture means located in the upper portion of the body for aid in gripping the device by hand, and a plurality of spaced-apart conically-shaped finger elements of a predetermined configuration formed into the lower portion of the body, said finger elements defining a plurality of spaces located between each finger element such that the shape of the spaces is substantially the same as the inverted shape of the finger elements, whereby in use the finger elements extend into the surface of the granular material and, when moved in a forward or backward direction, smooth and level any irregularities in the surface thereof.

10 Claims, 2 Drawing Sheets

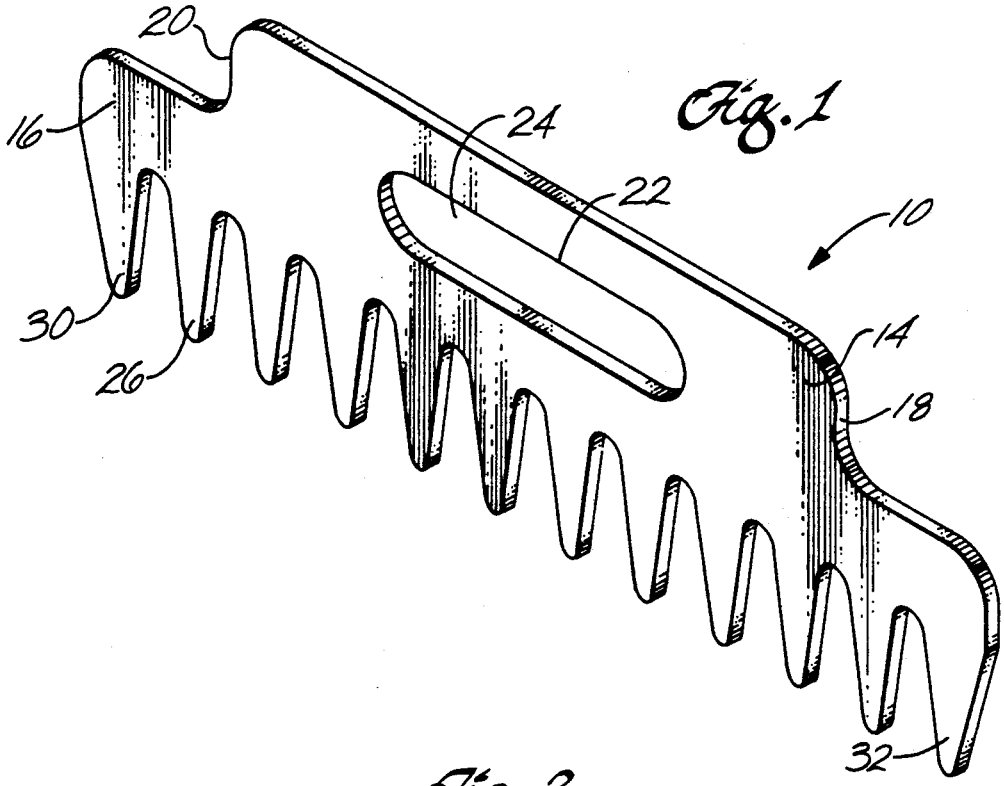
Fig. 1
Fig. 2
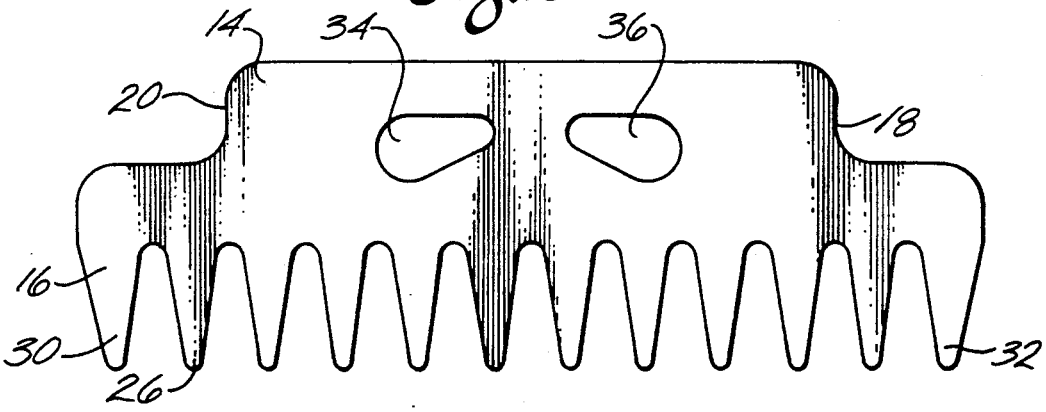
Fig. 3
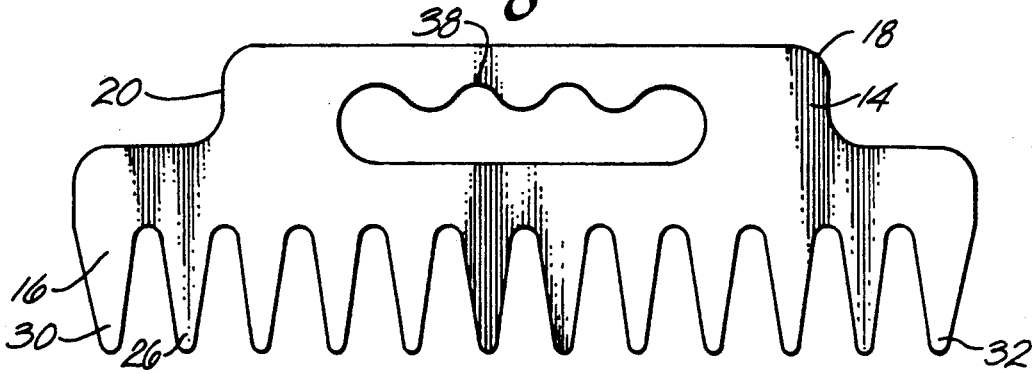

APPARATUS FOR SMOOTHING GRANULAR MATERIAL

FIELD OF THE INVENTION

This invention relates a leveling device for smoothing and leveling granular materials, and more particularly, to a sand comb comprised of an elongated body having an upper portion in which is incorporated a handle, and a lower portion in which is incorporated a plurality of finger elements which extend into the surface level of the granular material and, when moved in a forward or backward direction, smooth and level any surface irregularities.

BACKGROUND OF THE INVENTION

Sunbathers and beach goers alike face the problem of a bumpy or irregular surface in the sand which makes it uncomfortable to lie upon. All beach areas have an irregular surface area due to human, as well as natural, activity. Human activity such as volleyball, jogging, bicycling and walking all result in the surface of the sand being displaced in an irregular pattern. Similarly, natural forces such as the wind, the tide and activity of animals also contribute to the irregular pattern of the surface level of the sand.

Innovative beach goers attempt to level the surface area of the sand by using their hands or feet or by just attempting to cover up the surface irregularities by using a blanket. These methods have proven to be ineffective for creating a smooth level surface which would be comfortable to sun bathe or just relax upon.

An apparatus currently available for smoothing and leveling surface irregularities in the sand would be a conventional garden rake. However, it is hardly convenient for beach goers to transport and store a garden rake when planning an outing at the beach.

It is therefore, desirable to provide a portable, lightweight, hand-operated sand smoothing apparatus which is inexpensive and easy to use.

SUMMARY OF THE INVENTION

There is, therefore, provided in practice of this invention, a one-piece leveling device for smoothing and leveling a surface of granular materials comprising a rigid elongated completely planar body having an upper and lower portion with the upper and lower portions each having a predetermined configuration. Aperture means are located in the upper portion of the body for aid in gripping the device by hand and a plurality of spaced apart tapered finger elements of a predetermined configuration are formed into the lower portion of the body. The finger elements define a plurality of spaces, each located between adjacent finger elements and having a shape that is substantially the same as an inverted shape of the finger elements, whereby in use the finger elements extend into the surface of the granular material and, when moved in a forward or backward direction, smooth and level any irregularities in the surface thereof in a uniform pattern.

BRIEF DESCRIPTION OF THE DRAWINGS

These and other features and advantages of this invention will be appreciated upon consideration of the following detailed description when considered in connection with the accompanying drawings wherein:

FIG. 1 illustrates isometrically an exemplary leveling device constructed according the principles of this invention;

FIG. 2 is a frontal view of a second alternative embodiment of the present invention;

FIG. 3 is a frontal view of a third alternative embodiment of the present invention;

DETAILED DESCRIPTION

Figure 4:
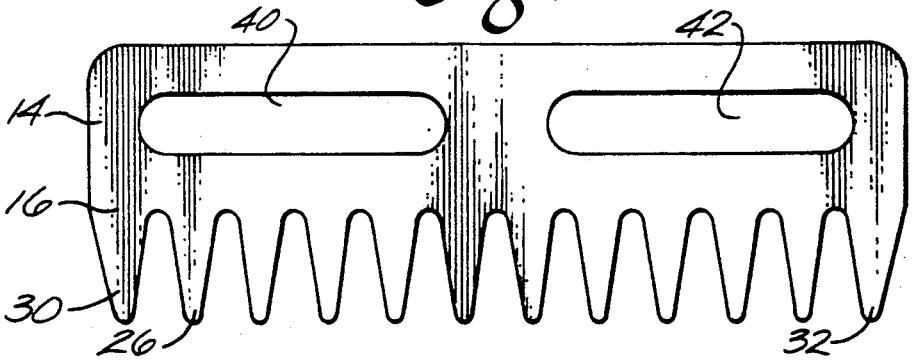
FIG. 4 is a frontal view of a fourth alternative embodiment of the present invention.

Referring to the drawings, FIG. 1 illustrates a leveling device 10 constructed in accordance with the principles of this invention. The leveling device 10 is comprised of a rigid elongated body 12 having an upper portion 14 and a lower portion 16. Located adjacent the edge surface of the upper portion are shoulders 18 and 20 which border the outer edges of a handle 22. Also located in the upper portion is at least one centrally located aperture 24 wide enough so that one or more fingers of an open, human hand may slide into the slot and grasp the handle in order to manipulate the device.

Formed into the lower portion of the body are a plurality of finger elements in the form of teeth or serrations 26. The teeth are generally conical in shape and are located at spaced intervals along the length of the elongated body. The shape of the teeth or serrations in the presently preferred embodiment is such that the spaces between the teeth have a symmetrical shape, substantially that of the teeth, only inverted. The outside teeth 30, 32 on either end have tapered outside surfaces which also merge with the upper portion and form the outside surfaces of the lower portion of the body.

FIG. 2 illustrates a second alternative embodiment of the present invention, the principal difference being that the gripping means comprises two oblong holes 34 and 36 instead of a single aperture as in FIG. 1. In this instance, one or more fingers on each hand can be placed through each hole in order to manipulate the device.

FIG. 3 shows a third alternative embodiment of the present invention, similar to FIG. 1 but incorporating a plurality of ridges 38 along the top edge of the slot which create a conforming gripping surface for the fingers.

FIG. 4 shows a fourth alternative embodiment of the present invention, however, eliminating the shoulders in the upper portion such that the upper portion extends the entire length of the elongated body in order to position two symmetrically located slots 40 and 42, similar to that in FIG. 1, so that the device may be operated by two hands.

Figure 5:
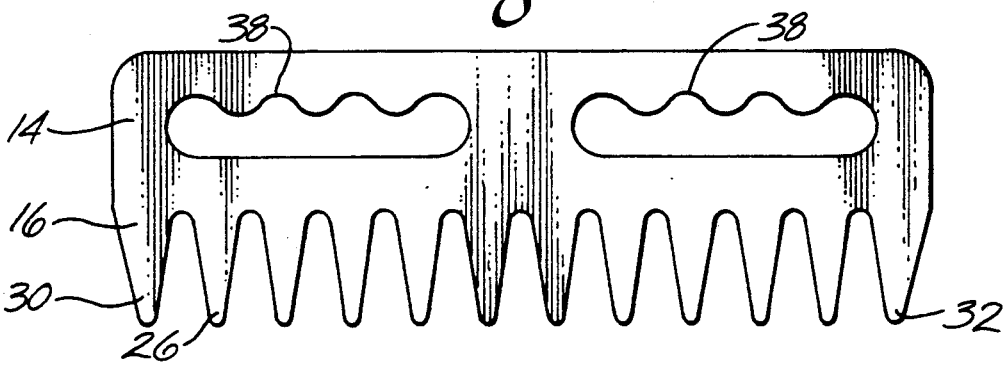
FIG. 5 is a frontal view of a fifth alternative embodiment of the present invention.

FIG. 5 is similar to FIG. 4, with the addition of the finger ridges or receptacles as in FIG. 3 to form a better gripping surface along the top edge of the slots.

Figure 6:
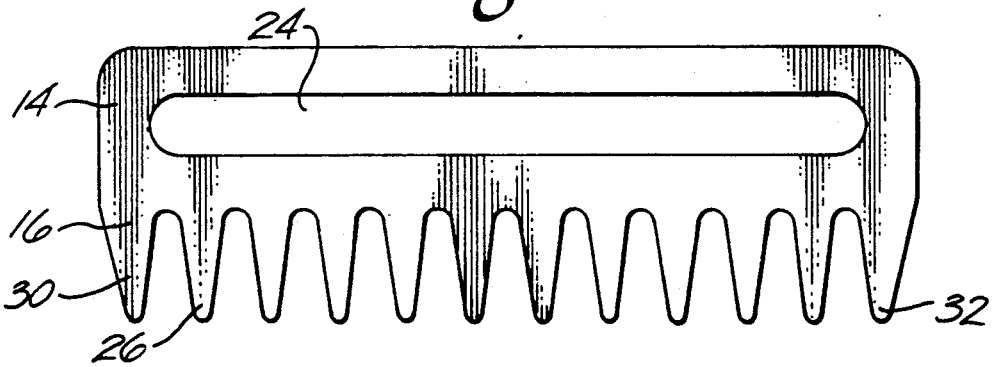
FIG. 6 is a frontal view of a sixth alternative embodiment of the present invention.

FIG. 6 is similar to FIGS. 4 and 5 in that the shoulders of FIG. 1 have been eliminated and the upper portion of the body extends the entire length of the body. Unlike FIG. 4, however, one long continuous slot is located in the upper portion such that the user can position one or both hands anywhere along the handle of the device.

Figure 7:
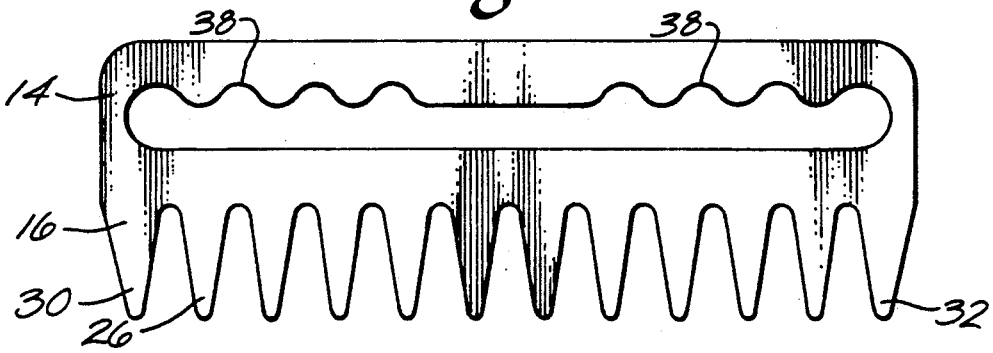
FIG. 7 is a frontal view of a seventh alternative embodiment of the present invention.

Similarly, FIG. 7 is like FIG. 6, but additionally incorporates finger ridges or receptacles along the top surface of the slot which can either be positioned in two locations at opposite ends of the slot, as shown in FIG. 7, or can be located along the entire top surface of the slot (not shown).

The leveling device is made of a rigid material such as ABS plastic having sufficient strength to overcome the resistance of the granular material in order to push the granular material when used to smooth its surface. The leveling device can be manufactured by a number of molding processes, such as injection molding or compression molding. The surface of the device is conducive to printing or silkscreening for advertising or promotional purposes.

In use, the operator simply grasps the leveling device with one or both hands at the aperture or apertures, slot or slots, in the upper portion of the device, and then inserts the finger elements of the lower portion of the device into the surface level of the granular material and pushes or pulls the device in a forward or backward direction thus leveling any surface irregularities and creating a smooth and level surface.

What is claimed is:

1. A one-piece leveling device for smoothing and leveling a surface of granular materials comprising:

a rigid elongated completely planar body having an upper and lower portion, said upper and lower portions each having a predetermined configuration;

aperture means located in the upper portion of the body for aid in gripping the device by hand; and a plurality of spaced apart tapered finger elements of a predetermined configuration formed into the lower portion of the body, said elements defining a plurality of spaces, each located between adjacent finger elements and having a shape that is substantially the same as in inverted shape of the finger elements, whereby in use the finger elements extend into the surface of the granular material and, when moved in a forward or backward direction, smooth and level any irregularities in the surface thereof in a uniform pattern.

2. A leveling device of claim 1 wherein the aperture means is a centrally located slot large enough to allow one or more fingers of an operator to pass through.

3. A leveling device of claim 1 wherein the aperture means is two symmetrically located oblong holes large enough to allow at least one finger of an operator to pass through.

4. A leveling device of claim 2 wherein gripping means are located along the top surface of the slot.

5. A leveling device of claim 1 wherein the aperture means are two symmetrically located slots each large enough to allow a user's fingers to pass through.

6. A leveling device of claim 5 wherein gripping means are located along the top surface of each slot.

7. A leveling device of claim 1 wherein the aperture means is a slot which extends substantially the length of the body.

8. A leveling device of claim 7 wherein gripping means are located along the top surface of the lot.

9. A leveling device of claim 1 wherein the elongated body is made of rigid material having sufficient strength to overcome any resistance of the granular materials in order to smooth and level the surface thereof.

10. A leveling device of claim 1 wherein the finger elements are located at spaced intervals along the length of the lower portion of the body.

* * * * *

UNITED STATES PATENT AND TRADEMARK OFFICE

CERTIFICATE OF CORRECTION

PATENT NO. : 5,125,459

DATED : June 30, 1992

INVENTOR(S) : Stephen J. Richards

It is certified that error appears in the above-identified patent and that said Letters Patent is hereby corrected as shown below:

Column 4, line 3, before "inverted" change "in" to -- an --.

Column 4, line 27, change "lot" to -- slot --.

Signed and Sealed this

Twenty-eighth Day of September, 1993

Bruce Lehman

*Attest:*

BRUCE LEHMAN

*Attesting Officer*

*Commissioner of Patents and Trademarks*